US005478525A

United States Patent [19]

Smith et al.

[11] Patent Number: 5,478,525

[45] Date of Patent: Dec. 26, 1995

[54] EXTRUDABLE CORROSION RESISTANT ALUMINUM ALLOY

[75] Inventors: Warren A. Smith, Milan; Alan L. Study, Southfield, both of Mich.

[73] Assignee: Ford Motor Company, Dearborn, Mich.

[21] Appl. No.: 168,314

[22] Filed: Dec. 17, 1993

[51] Int. Cl.[6] ..... C22C 21/00

[52] U.S. Cl. ..... 420/553

[58] Field of Search ..... 420/553; 148/415

[56] References Cited

U.S. PATENT DOCUMENTS 4,499,050 2/1985 Tong ..... 420/553

5,286,316 2/1994 Wade ..... 420/553

*Primary Examiner*—Deborah Yee

*Attorney, Agent, or Firm*—Joseph W. Malleck; Roger L. May

[57] ABSTRACT

An extrudable brazeable corrosion resistant aluminum alloy, consisting essentially of, by weight percent, 0.1–0.2 titanium, 0.6–1.2 manganese, up to 0.1 silicon, up to 0.2 iron, and other impurities up to 0.15, with each such other impurity no greater than 0.03, and the remainder aluminum.

A method of fabricating a heat exchange tube array, by (i) extruding aluminum alloy tubing of the above composition to a uniform wall thickness of about 0.4mm; (ii) bending and/or arranging the tubes to form a tube array for conducting a fluid medium therethrough; (iii) interposing an aluminum-based heat exchange means between and in contact with the tubes of the array to provide for heat transfer; (iv) brazing the heat exchange means to the tube array by heating to the temperature range of 595° C. whereby the tube array will not be adversely affected metallurgically by the brazing operation.

5 Claims, 3 Drawing Sheets

EXTRUDABLE CORROSION RESISTANT ALUMINUM ALLOY

BACKGROUND OF THE INVENTION

1. Technical Field

This invention relates to the technology of extruding aluminum alloys and more particularly to such alloys that are usable in heat exchangers for automotive vehicular applications.

2. Discussion of the Prior Art

Low cost heat exchange tubes made of an aluminum alloy have been heretofore made with relatively thick walls, such as 0.60 millimeters. Such tubing has been made by a process of casting a billet and extruding or drawing the billet to produce a hollow shape, typical alloys for the billet usually contain silicon (0.3% or more by weight), iron (at least 0.4%), copper (at least 0.15%), manganese (1.0%) and the remainder aluminum.

To achieve thinner walled tubing, the extrudable characteristic of the alloy must be enhanced by employing a purer aluminum alloy containing less than about 0.3 percent by weight manganese. However, such enhanced-extrudable alloys will not meet extended life requirements because of possible corrosion and lower fatigue strength. Certain elements which retard corrosion in a nonextruded product (such as disclosed in U.S. Pat. No. 4,694,087) cannot be added to an extrusion alloy because they retard extrudability. Moreover, brazing of an extruded thin wall aluminum-based tubing often causes extensive penetration of the tubing by the elements of the brazing filler metal, thereby resulting in thinning and poor corrosion resistance from a changed microstructure.

SUMMARY OF THE INVENTION

It is an object of this invention to provide an extrudable aluminum alloy for thin-walled heat exchange tubing that has improved corrosion resistance and has increased strength. The invention adds titanium in a critical amount to relatively pure aluminum to achieve a first plateau of corrosion resistance, and then adds manganese in a critical amount to achieve a second but higher plateau of corrosion resistance accompanied by an increase in yield strength of at least 10%. Impurities must be limited to ultra low levels, particularly iron and silicon, with all other impurities limited to 0.15 percent by weight of the alloy.

Thus, the invention, in a first aspect, is an extrudable brazeable corrosion resistant aluminum alloy, consisting essentially of by weight percent, 0.1–0.2 titanium, 0.6–1.2 manganese, up to 0.1 silicon, up to 0.2 iron and other impurities up to 0.15, with each such other impurity no greater than 0.03, and the remainder aluminum.

Another aspect of this invention is a method of fabricating a heat exchanger tube array, by (i) extruding aluminum alloy tubing of the above composition to a uniform wall thickness of about 0.4mm; (ii) bending and/or arranging the tubes to form a tube array for conducting a fluid medium therethrough; (iii) interposing an aluminum-based heat exchange means between and in contact with the tubes of the array to provide for heat transfer; and (iv) brazing the heat exchange means to the tube array by heating to the temperature range of 595° whereby the tube array will not be adversely affected metallurgically by the heat of brazing.

DETAILED DESCRIPTION AND BEST MODE

The highly extrudable aluminum composition of this invention consists essentially of, by weight percentage: 0.1–0.2 titanium, 0.6–1.2 manganese, up to 0.1 silicon, up to 0.2 iron, and other impurities up to 0.15, with each such other impurity no greater than 0.03, and the remainder aluminum. This is a purer aluminum alloy than that used heretofore for making heat exchanger tubing. The alloy has only 1.4 percent additives, and impurities are limited to a total of 0.45 percent which is an extremely low amount. When the prior art utilized titanium and/or manganese or copper in an aluminum alloy, the titanium and manganese were combined with copper with relatively higher amounts of impurities to provide corrosion resistance based upon complex large particle intermetallics. In this invention, the titanium and manganese are combined with low levels of impurities to enhance corrosion resistance.

The controlled amount of titanium is based upon its ability to change the corrosion morphology from hemispherical pitting to a lateral type attack. Less than 0.1 percent titanium will not achieve the desired first plateau of corrosion resistance desired by this invention; titanium in excess of 0.2 may not dissolve adequately in the aluminum base, and may from undesirable intermetallics. Titanium creates a fine grain structure in the as-cast extrusion billet which improves extrudability.

Manganese is added to achieve a still higher plateau of corrosion resistance while also adding needed strength to the aluminum alloy so that it may be extruded in relatively thin tubes having structural integrity. Manganese adds to corrosion resistance of the brazed product by resisting silicon penetration (from the brazing metal) into the extrusion alloy during brazing. Manganese is typically added to aluminum alloys, particularly 3003 or 3005 type, to increase strength.

The proper amount of manganese inhibits brazing filler metal penetration when utilized in a brazing application; manganese precipitates as $MnAl_6$ in fine particles at the grain boundary to act as a blockade to silicon penetration from the filler alloy. This prevents silicon diffusion into the base metal to maintain good corrosion resistance.

Figure 7:
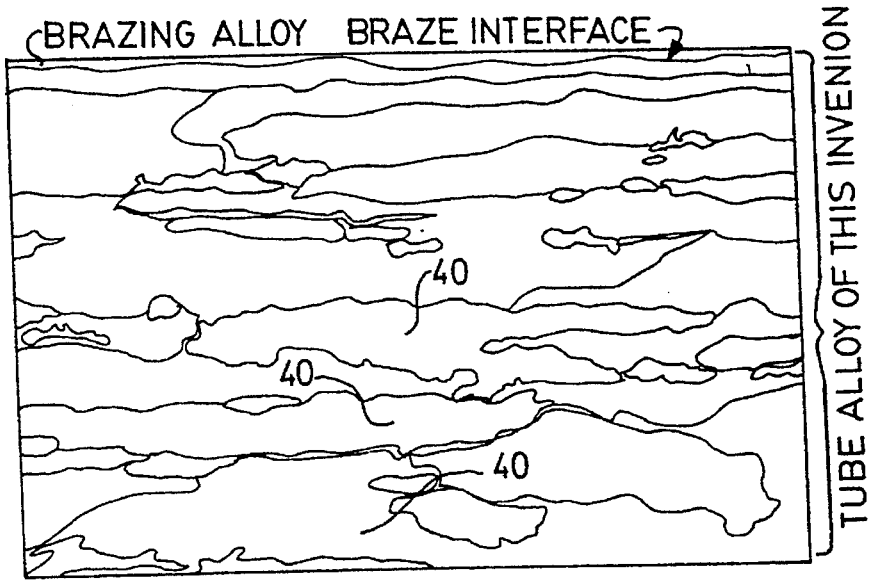
FIGS. 7 and 8 are depictions of polarized light photographs (200×magnification) of a brazed condenser tube cross-section made in accordance with the method and alloy of this invention, FIG. 7 being a longitudinal section and FIG. 8 being a transverse section.
Figure 8:
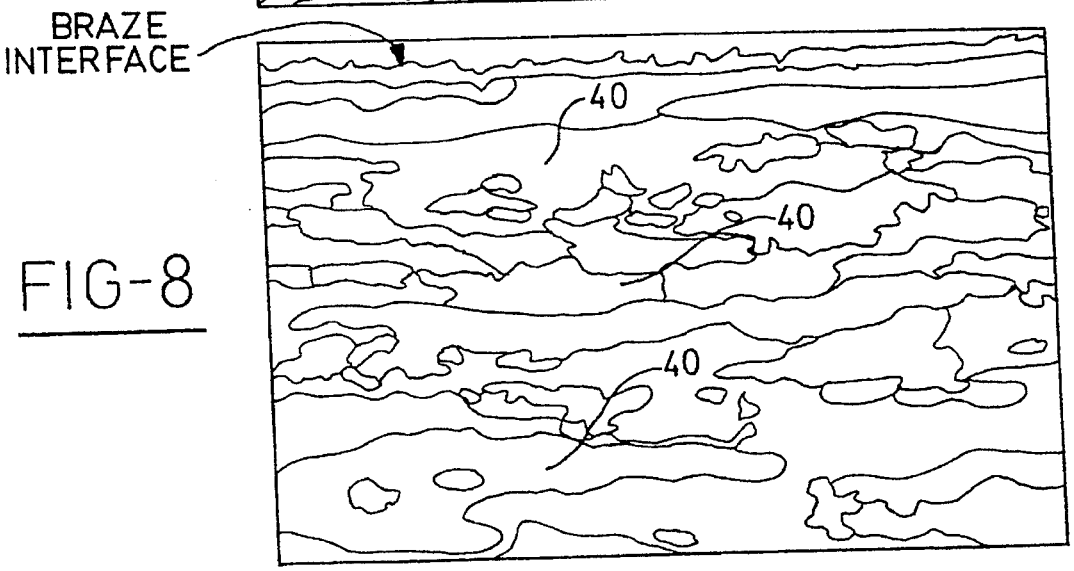

It is critical that silicon and iron be specifically controlled to amounts that avoid reducing corrosion resistance. Silicon is favored in prior art aluminum alloys to increase strength, but such property must be sacrificed here because of its detriment to extrudability. Iron is limited to 0.2 percent to eliminate the presence of iron particles that smear on the surface of the tube creating corrosion sites in the extruded material. Iron, when allowed to be present in amounts up to 0.4–0.5 percent, leaves significantly large particles which stick out of the inherent oxide film on the alloy surface. The controlled silicon and iron amounts facilitate formation of elongated grains that are more resistant to corrosion when subjected to the heat of brazing. The grains become enlarged pancake configurations that have a larger dimension in both the X-Y directions as shown in FIGS. 7–8. Limitation of silicon and iron to the critical amount along with control of manganese, as an additive, induces this grain growth during heat brazing.

The alloy of this invention has a corrosion life that is two times the duration of conventional aluminum alloys such as 3003 or 3005. The alloy herein can typically resist perforation up to 150 hours of exposure per ASTM G-85 method G-43, and has a yield strength of at least 11 ksi (15.7Kg/$mm^2$) in the as-produced state.

Figure 1:
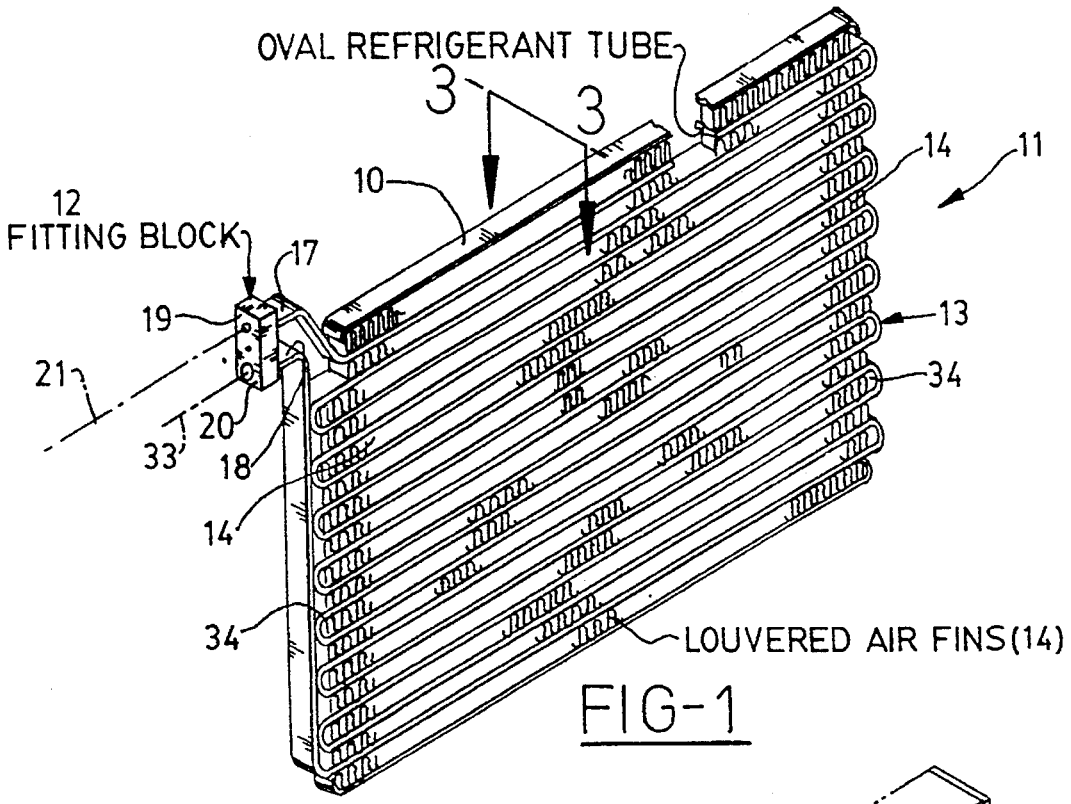
FIG. 1 is an elevational view of a brazed condenser used in an automotive vehicle for which the alloy of this invention has applicability.
Figure 2:
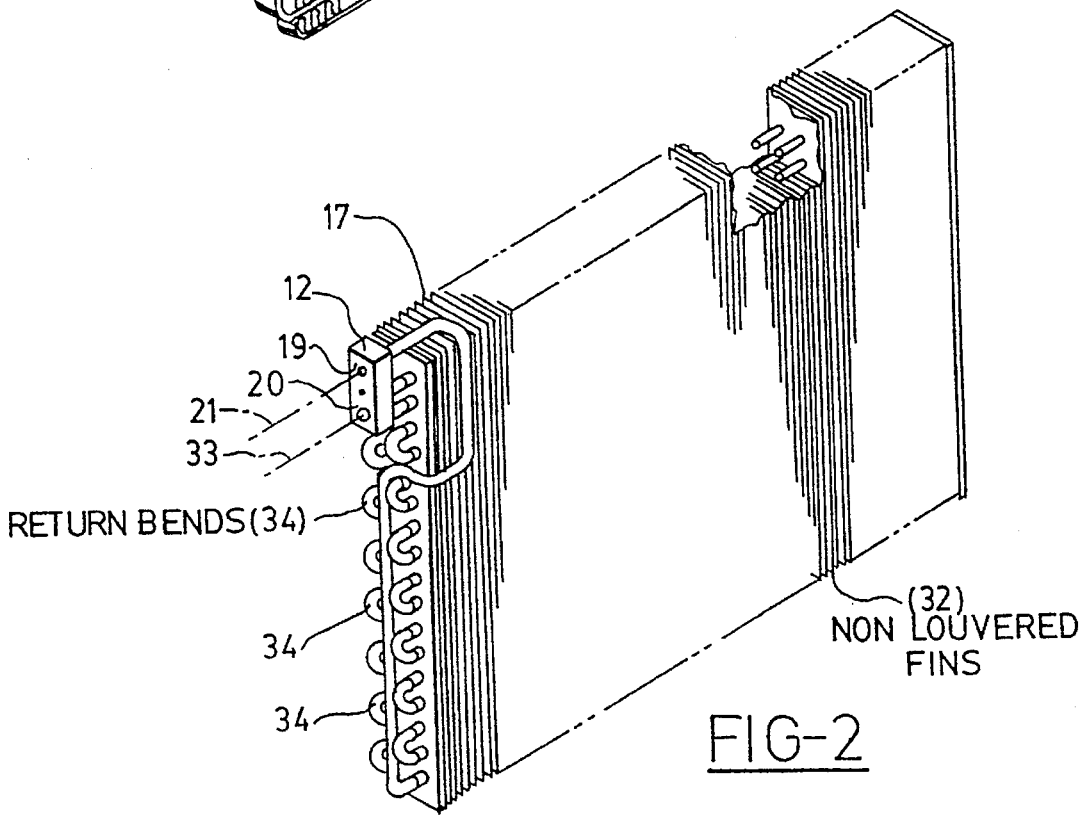
FIG. 2 is a view of a mechanically assembled condenser used in automotive applications.
Figure 3:
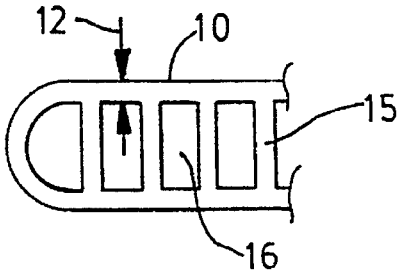
FIG. 3 is a greatly enlarged perspective sectional view of the tubing used in the condenser of FIG. 1.

As shown in FIGS. 1–3, the alloy is particularly useful as the metal for forming extruded tubing 10 for an air conditioning condenser 11. The function of the condenser is to remove the heat absorbed by the evaporator and the energy added by the compressor by means of an approximately constant temperature condensation process. The refrigerant side of the condenser must first bring the refrigerant from a superheated vapor down to saturation point, and then the fluid condenses. Finally, subcooled liquid refrigerant is discharged from the condenser. The tubing has a wall thickness 12 of about 0.4mm and is produced by the steps of casting a billet and then extruding or drawing such billet around a die cavity. Tubing may have extruded webbing 15 within the tube to define a series of channels 16 within each tube thereby defining an array. Alternatively, a series of tubes 10 may be arranged side by side to form such tube array. The tube 10 is shaped in a serpentine fashion (shown in FIG. 1) and between which is interposed banks 14 of folded or corrugated conductive fin sheet material; the banks 14 permit flow of a heat exchange fluid or gas across the tube array 13 to promote heat transfer. The fins 14 are metallurgically bonded to the tubes by means of a vacuum or controlled atmosphere brazing. Alternatively, the tubes 10 may be linearly straight in some applications without use of the serpentine bends. A fitting block 12, acts as headers 19,20 to connect respectively to the inlet 17 of the tubes and to the outlets 18 of the tube array. A supply line 21 connects to header 19 and a return line 33 connects to the header 20. A round tube array may be assembled mechanically to the fin banks by an expansion process resulting in the construction of FIG. 2. Mechanically assembled condenser 30 has a tube/fin heat exchanger made of the aluminum alloy with tubes 31 mechanically expanded into the fins 32 so as to create a heat transfer path. The alloy of this invention is particularly helpful in preventing pitting corrosion of the exposed hairpin turn areas 34 (see FIGS. 1 and 2) which have proved to be subject to accelerated corrosion in prior art constructions.

Certain method aspects are useful when employing the alloy herein to fabricate brazed heat exchanger tube arrays. The method comprises (a) extruding the previously described aluminum alloy into tubes of a uniform wall thickness of about 0.4mm; (b) bending and/or arranging the tubes to form a tube array for conducting a fluid medium therethrough; (c) interposing aluminum based heat exchange means between and in contact with the tubes of the tube array to provide for heat transfer; and (d) brazing the heat exchange means to the tube array by heating to the temperature range of 595° C., the tube array is not adversely affected metallurgically by the brazing operation. Due to the critical content of manganese and the absence of more than 0.45 percent impurities, the alloy will contain fine precipitates of manganese in a course grain structure which will act to minimize silicon penetration from a braze filler alloy during the brazing step.

Figure 4:
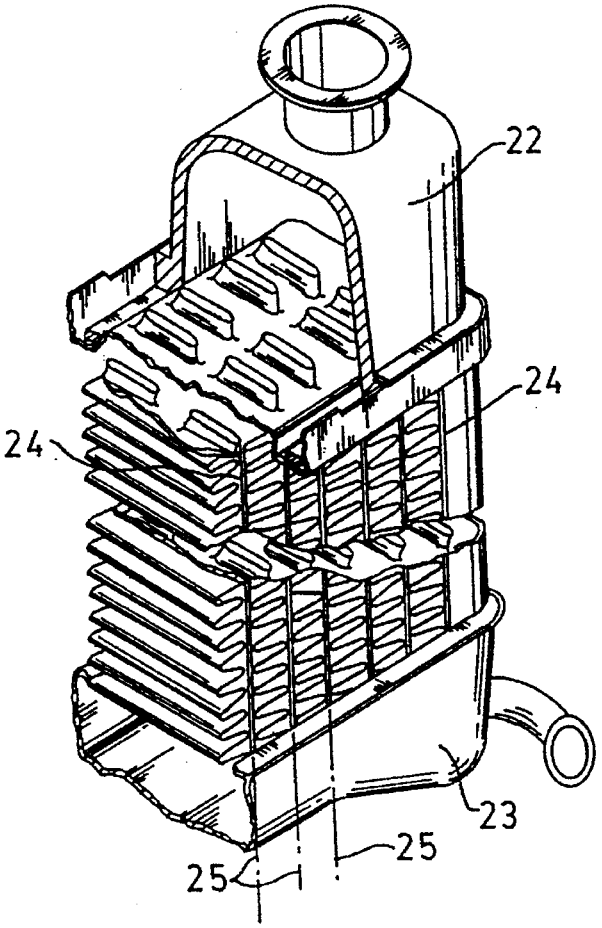
FIG. 4 is a perspective view (partly broken away) of a radiator construction useful in an automotive vehicle fabricated by the method of this invention.
Figure 5:
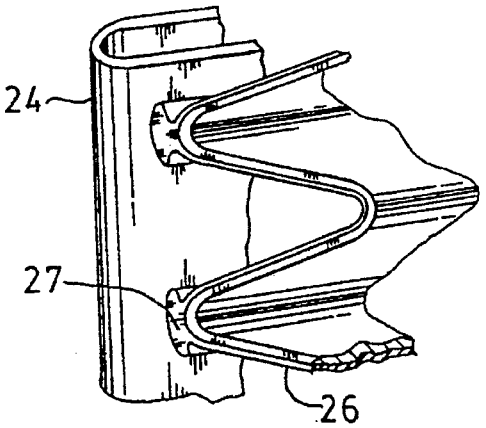
FIG. 5 is a greatly enlarged portion of FIG. 4.

Such method is particularly useful in constructing a radiator, air conditioning condenser, or similar heat exchanger for an automotive vehicle. As shown in FIGS. 4–5, extruded flat tubing 24, fabricated of the alloy of this invention, is arranged in spaced layers 25 between and in fluid communication with headers 22, 23. Corrugated fins 26 of aluminum based material are stacked between the tube layers. The sheet material of the fins may be clad with a brazing alloy 27 comprising about 10 percent silicon, with the remainder aluminum. The fins are joined to the tubes by brazing which results in fillets 28. Brazing may be carried out by applying heat to the brazing alloy at the joint area up to a temperature of about 595° C. which causes the clad material to melt at that location and form the fillets 28 by surface tension. Upon cooling, the fillets bond to the tubing as well as the corrugated fins.

Figure 6:
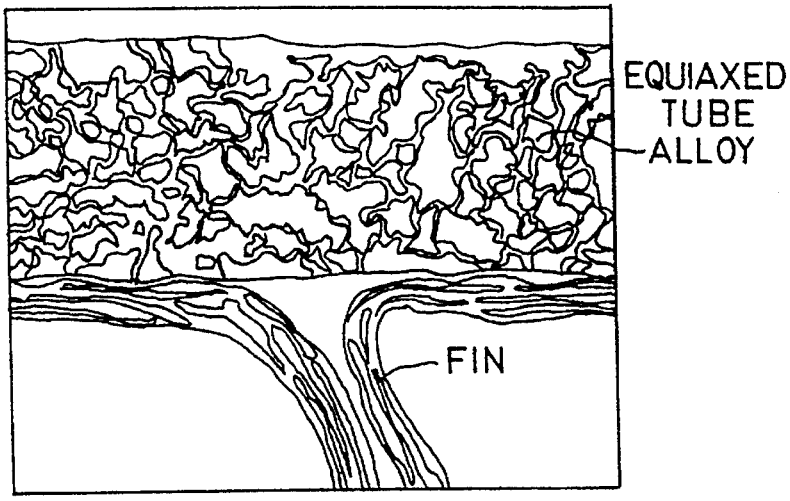
FIG-6 PRIOR ART
FIG. 6 is a depiction of a polarized light photograph (100×magnification) of a prior art brazed condenser tube cross-section.

The grain structure of the resulting brazed tubing at the joint will be decidedly different than prior art aluminum alloys. As shown in FIG. 6, a magnified cross-section (100×) of a brazed condenser tube section, shows the prior art alloy (by way of polarized light) as having uniform equiaxed grains. The heat of brazing was about 595° C.

In contrast, FIGS. 7–8 (respectively showing longitudinal and transverse etched (1% HF) sections of tubing at a higher magnification of 200×) show the post-brazed alloy of this invention to have elongated pancake-like grains 40. The elongation occurs in both the X and Y directions as demonstrated by the respective longitudinal and transverse views. Manganese precipitates fine particles at the pancake like grain boundaries with fewer grain boundary sites. The silicon in the brazing alloy does not significantly penetrate laterally into the tubing material.

The corrosion resistance of the alloy specimens, represented in FIGS. 7 and 8, was tested to have a corrosion life of at least two times the duration of conventional aluminum alloys. This was determined by a cyclical acceleration test (ASTM G-85 method G43) which utilizes approximately eight inch tube samples, pressurized to 150 psig to test for perforations after being retained in a corrosive environment for several days. The tubing, tested for yield strength, evidenced a strength of at least 11 ksi in the as-extruded condition.

We claim:

1. An extrudable brazeable corrosion resistant aluminum alloy, consisting essentially of, by weight percent, 0.1–0.2 titanium, 0.6–1.2 manganese, up to 0.10 silicon, up to 0.2 iron, and other impurities up to 0.15, with each such other impurity no greater than 0.03, and the remainder aluminum.

2. The alloy as in claim 1, which has a microstructure of elongated pancaked grains having the plane of the pancake aligned with the direction of extrusion when subjected to heat in the temperature range of 595° C.

3. The alloy as in claim 2, which exhibits precipitation of fine manganese particles at the grain boundaries of said pancaked grain microstructure, to inhibit braze filler metal penetration.

4. The alloy as in claim 1, which has a yield strength of at least 11 ksi (15.7 $Kg/mm_2$) in the as-extruded condition.

5. The alloy as in claim 1, when extruded into tubing, has a wall thickness of about 0.4mm and exhibits a resistance to perforation at least 2 times the exposure of conventional alloys in a cyclical accelerated corrosion test per ASTMG-85 method G43.

* * * * *